United States Patent [19]

Weipert

[11] 4,078,269

[45] Mar. 14, 1978

[54] LITTER FRAME WITH SUPPORTING PLATFORM WHICH CAN BE RAISED BY HYDRAULIC OR PNEUMATIC JACK

[75] Inventor: Jörn Weipert, Lorch, Germany

[73] Assignee: Firma Binz & Co., Germany

[21] Appl. No.: 718,462

[22] Filed: Aug. 30, 1976

[30] Foreign Application Priority Data

Aug. 29, 1975 Germany ..... 2538411

[51] Int. Cl.[2] ..... A61G 7/10; A47C 3/32

[52] U.S. Cl. ..... 5/63; 5/118; 5/86; 254/122; 296/19

[58] Field of Search ..... 5/61, 62, 118, 82, 63, 5/81, 86; 254/DIG. 9, 122, 124; 108/147; 296/19, 20; 248/399, 400, 421, 4

[56] References Cited

U.S. PATENT DOCUMENTS

| | | | |
|---|---|---|---|
| 3,003,724 | 10/1961 | Kiekhaefer | 248/4 |
| 3,203,670 | 8/1965 | Farris | 254/122 |
| 3,218,019 | 11/1965 | Elfes et al. | 248/399 |
| 3,240,452 | 3/1966 | Cheeseboro | 248/4 |
| 3,266,774 | 8/1966 | Goyarts | 254/122 |
| 3,478,372 | 11/1969 | Benoit et al. | 5/63 |
| 3,493,211 | 2/1970 | Barecki et al. | 248/399 |
| 3,711,876 | 1/1973 | Kirkland et al. | 5/62 |
| 3,733,623 | 5/1973 | Groxton | 5/62 |
| 3,752,526 | 8/1973 | Der Burgt et al. | 296/19 |
| 3,831,996 | 8/1974 | Layer | 296/19 |
| 3,918,554 | 11/1975 | Bourgraf et al. | 296/19 |

*Primary Examiner*—Casmir A. Nunberg
*Attorney, Agent, or Firm*—Craig & Antonelli

[57] ABSTRACT

A litter frame having a supporting platform is adapted to be raised by a hydraulic or pneumatic jack. A common pneumatic or hydraulic system is provided to both raise the platform and to provide spring suspension for the same. Where a common hydro-pneumatic system is provided, the jack assembly is actuated by a hydraulic medium, while a hydro-pneumatic cushioning assembly is loaded by the hydraulic medium. The hydraulic medium is delivered to both the jack and the hydro-pneumatic system from the same hydraulic supply.

22 Claims, 10 Drawing Figures

FIG. 9
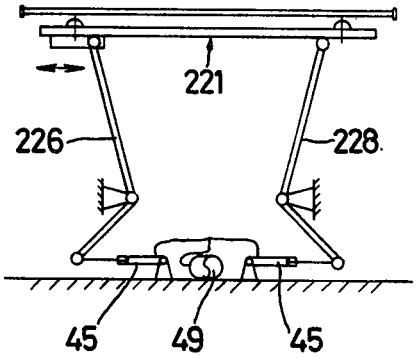
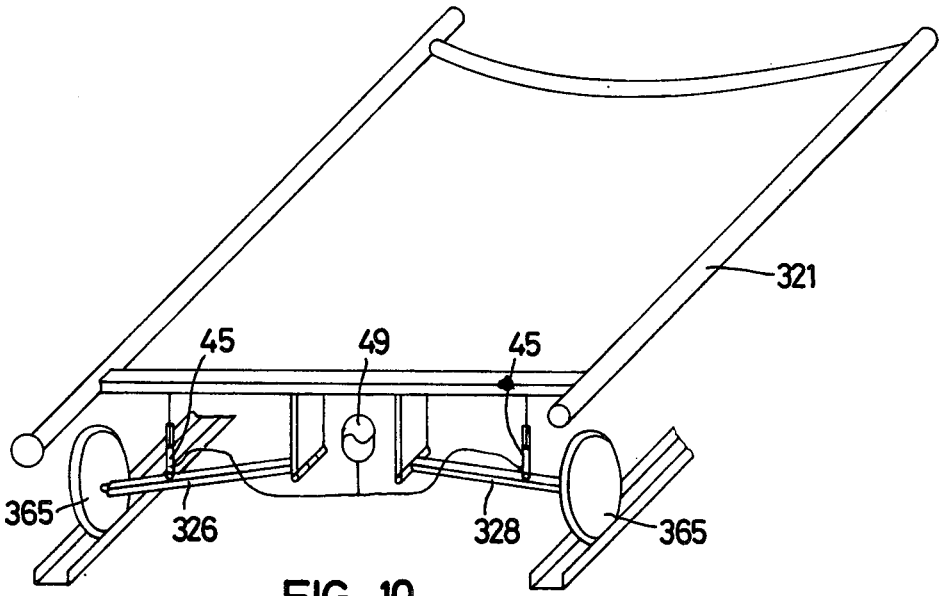
FIG. 10

LITTER FRAME WITH SUPPORTING PLATFORM WHICH CAN BE RAISED BY HYDRAULIC OR PNEUMATIC JACK

FIELD OF THE INVENTION

The present invention relates to a litter frame having a supporting platform which can be raised hydraulically or pneumatically.

BACKGROUND OF THE INVENTION

One example of a litter frame having a hydraulic piston jacking assembly is described in German Patent Number 1191513, particularly FIG. 14 of the patent. It is also known that litters can be spring-suspended so that, upon the occurrence of shocks, which occur particularly during periods of travel, the springsuspension will absorb the shocks and prevent the same from being transmitting to the supporting platform.

SUMMARY OF THE INVENTION

The present invention is addressed to the problem of an improved litter frame wherein the advantages of a supporting platform which can be raised by a jack can be combined with the advantages of spring suspension. Basically, in accordance with the present invention, a common pneumatic or hydro-pneumatic system is provided for jacking the platform and for, at the same time, providing spring suspension of the raised support platform.

In accordance with one embodiment of the invention, a common hydro-pneumatic system is provided, which system provides a jack assembly actuated by a hydraulic medium for actuating the jacking device. A hydro-pneumatic cushioning assembly is loaded by the hydraulic medium and a supply assembly which delivers the hydraulic medium under pressure to both the jack assembly and the spring-suspension assembly is provided. The spring assembly connected with the jack assembly, generally a cylinder-piston assembly, advantageously provides a storage device containing the pneumatic medium, separated from the jack assembly by a diaphragm or similar element.

The spring suspension is adjustable both in the hydro-pneumatic system and in the purely pneumatic system. In the first case, the hydraulic jack assembly may be adjustably connected with the hydro-pneumatic spring suspension assembly. An adjustable choke is disposed in the connection, particularly in parallel connection with a one-way valve which opens only in the direction of flow from the spring suspension assembly to the jack assembly.

There is also the provision of a check device by way of which the spring suspension assembly, at any height of the supporting platform, may be disconnected from both the hydro-pneumatic and purely pneumatic sustem. The check device in the hydro-pneumatic system may be a check valve interposed between the jack assembly and the spring suspension assembly.

The supply device for the hydraulic medium which creates the jacking and spring-like suspension pressure in the hydro-pneumatic system, and is provided as a pump or pressure-shotring device, works directly upon the jacking assembly, whereas the hydropneumatic spring suspension assembly, with an intermediately provided choke and check valve, is disposed in a branch of this system. The pressure of the hydraulic medium delivered from the supply assembly initially increases the pneumatic pressure in the spring storage device, until the pressure of the hydraulic medium is capable of jacking up the supporting platform, whereupon the raising of the platform continues until the supply is interrupted, by cutting off a motor, closing the supply line, or automatically opening an excess pressure valve. To lower the support platform, a return from the jacking assembly to the suction side of the supply assembly or to a storage receptable, hydraulic pressure storage device, or the like, is opened.

A general advantage of the present invention is the lack of need to provide a separate spring suspension assembly in addition to the jacking device, and, further, a system working with one auxiliary medium is used both for raising the platform and for suspending the same. The pneumatic or hydraulic medium which effects the jacking of the platform simultaneously permits spring-like suspension, advantageously whether or not the support platform is jacked up.

A futher advantage of the invention is that an especially soft, elastic support is created for the patient, and the spring-like suspension properties are practically independent of whatever the load may be on the support platform or upon the litter which rests on the platform. As a result, the spring-like suspension is independent of the load. Moreover, continuous adjustment of the support platform or the frame is possible.

As a further feature of the invention, the hydro-pneumatic spring suspension assembly and the hydraulic supply assembly may be arranged separately from the jacking assembly, especially at one end of the litter frame, to make use of the system more convenient. This can be accomplished slidably with the jack device and the hydro-pneumatic system as a whole on transverse shafts. Also, for jacking up the platform, a scissors frame may be provided, to permit tilting of the platform about a transverse shaft. In particular, the arrangement can be such that, for tilting the platform, sections of the scissors arms which immediately support the platform, above a middle pivot point which connects the the scissors arms with reference to the sections below the pivot point, are pivotable about this pivot point.

BRIEF DESCRIPTION OF THE DRAWINGS

FIGS. 9 and 10 illustrate other partial views of the application of the invention.

DETAILED DESCRIPTION OF THE INVENTION

Figure 1:
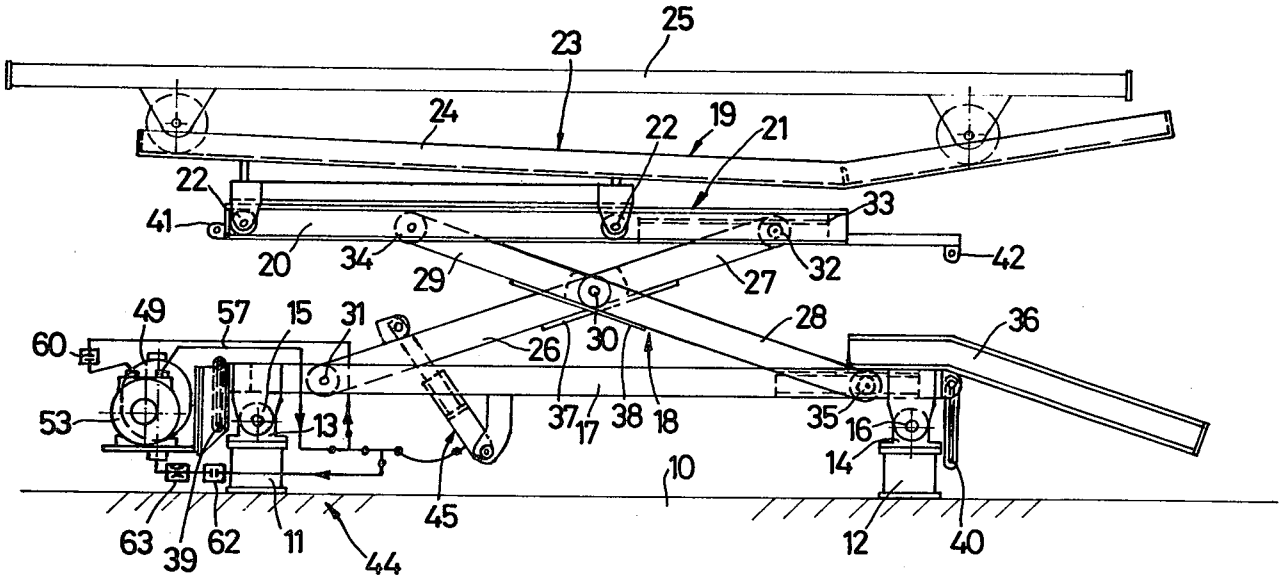
FIG. 1 is a side view of a litter frame according to the present invention, in its raised position.

Referring now to FIG. 1 of the drawings of the present invention, upon a vehicle floor 10, a lower frame 17, which cannot be jacked up, is supported upon a pair of bearing blocks 11 and 12, by way of two bolted upright bearings 13 and 14, so that the frame is displaceable in the transverse direction on shafts 15 and 16 passing through the bearings 13 and 14. Advantageously, the upright bearings 13 and 14 are ball-bearings which permit easy lateral shifting of the frame 17 along shafts 15 and 16 in their axial direction, normal to the drawings.

Platform 19, which can be raised by way of the jacking mechanism, to be described below, is connected by means of a jacking mechanism 18 with the lower frame 17. The platform 19 consists of a slide member 23 made up of a pair of lateral guide rails 24 upon which the litter 25 is supported, by means of a pair of rollers. The slide 23 is connected to an upper frame 21 having a pair of U-shaped guide rails 20 which receive rollers 22 to permit the slide 23 to be laterally displaceable along the rails 20.

The jacking device 18 is formed as a scissors frame consisting of two crossing arms, comprising parts 26 and 27 and parts 28 and 29, respectively, connected at a pivot point 30 which forms the point of intersection of the parts. In this manner, arm portion 26 is fixedly coupled to the lower frame 17 at a pivot point 31, while an opposite pivot point 32 of the upper arm portion 27 is guided longitudinally in the guide 33 on frame 21. The upper portion of the other scissors arm, portion 29, is pivotally coupled to the rail 20 at 34, while the lower portion 28 is slidably guided on the lower frame 17 at pivot location 35.

A pair of laterally downwardly bent rails 36 are fixedly connected with the lower frame 17 and form an extension of the upper frame 21 when the frame 21 is in its lowered position. Slotted coupling plates 39 and 40 at the ends of lower frame 17 can be connected by inserting pins of the like with the eyes 41 and 42 at the ends of the upper frame 21. In order that arm portions 26, 27 of one arm and 28 and 29 of the other arm cannot bend downwardly towards each other at pivot point 30, but can bend only upwardly, a pair of stop plates 37 and 38 are provided.

Figure 2:
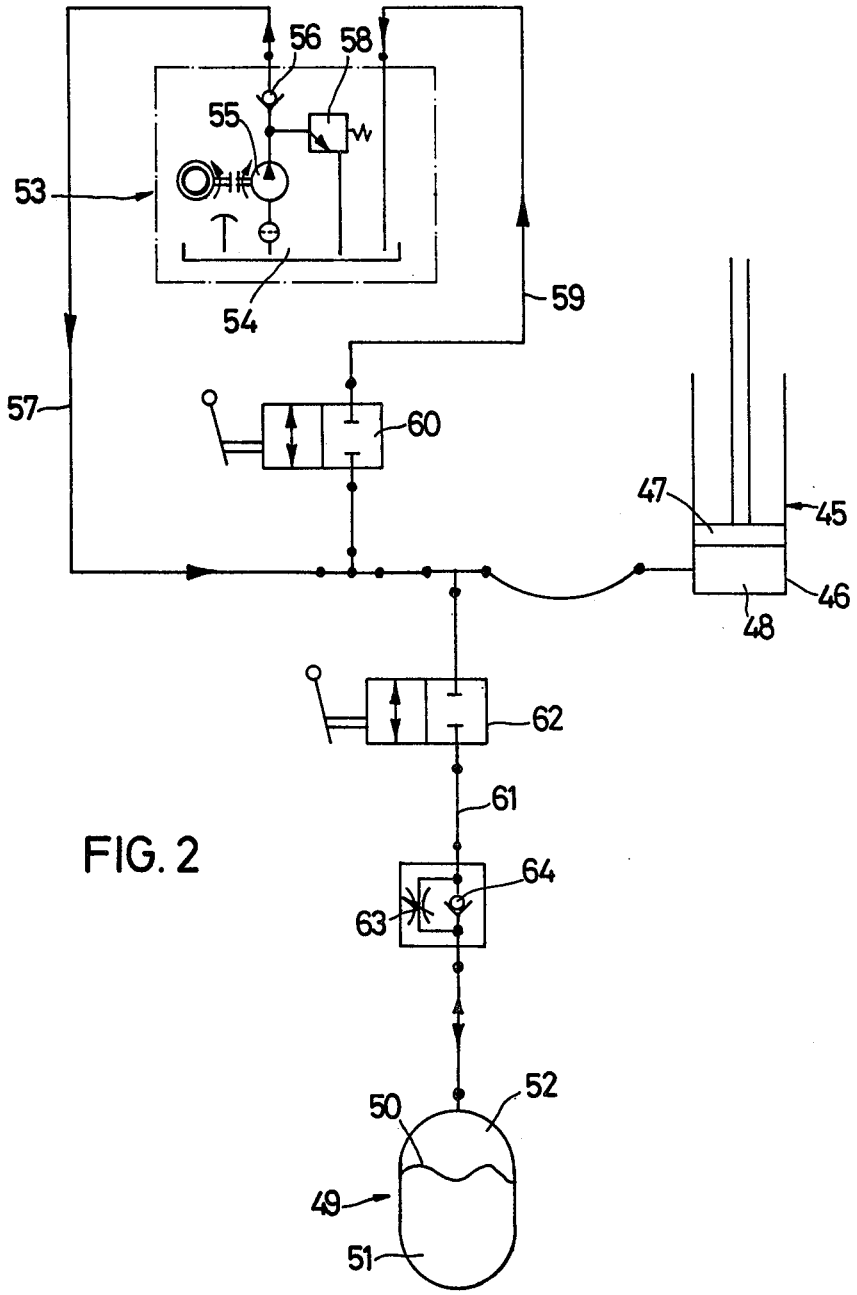
FIG. 2 is a circuit diagram for a hydro-pneumatic system employed in the present invention.
Figure 4:
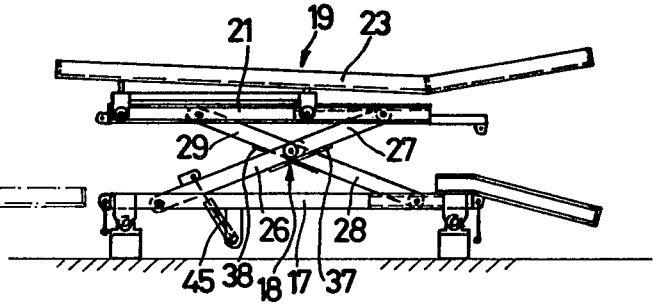
FIG. 4 is a side view of a litter frame with the platform raised.

A hydro-pneumatic system 44, the circuit diagram of which is illustrated in FIG. 2, is employed to raise and lower the platform 19 by means of jack device 18 and, at the same time, serves for spring-like suspension of the platform 19. The system 44 includes a hydraulic jacking assembly 45 in the form of a cylinder-piston assembly having a cylinder 46, a piston 47 and a cylinder chamber 48 which is under hydraulic pressure, so that the cylinder is connected to lower frame 17 and the piston is connected to one of the scissors arms, e.g. arm portion 26. Also provided is a spring assembly 49 having a diaphragm 50, a spring storage device 51 which is tightly closed and contains the pneumatic medium which serves as a pneumatic cushion, and a hydraulic pressure chamber 52, as well as a hydraulic supply assembly 53 with a reservoir 54, a pump 55 driven by the electric motor which delivers the hydraulic medium necessary for operation, by way of an excess pressure valve 56 to conduit 57, or returns the hydraulic medium to reservoir 54 by way of return flow valve 58.

Return conduit 59 is connected from conduit 57 by way of a check valve 60 to the supply assembly 53 or to the reservoir 54, to provide a return flow of the hydraulic medium from the cylinder chamber 48 to the supply assembly 53 when the check valve 60 is opened. A branch circuit 61 further connects the conduit 57 with the hydraulic pressure chamber 52 of spring assembly 49. Within the branch conduit there is another check valve 62 and an adjustable choke 63 connected in parallel with a check valve 64, so that only by way of this valve is flow permitted from pressure chamber 52 of the spring assembly toward the hydraulic jack assembly, blocking a return flow and only allowing it by way of choke 63. Choke 63 and valve 64 may be combined in a conventional manner.

The operation of the above-described system will be better understood with reference to FIGS. 3 through 6.

Figure 3:
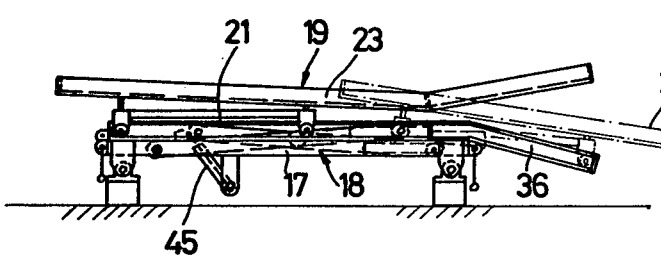
FIG. 3 is a side view of a litter frame with the support platform lowered and with the support slide longitudinally extended.

FIG. 3 illustrates the litter frame in the lowered supporting position, wherein platform 19 is in its lower most position. The upper frame 21 and its two guide rails are extended from the downwardly bent guide rails 36 so that the upper slide 23 can be moved out from the extended position as illustrated onto the downwardly bent extended guide rails 36 into position 23' for loading or unloading the platform. Pressure chamber 48, shown in FIG. 2, of the hydraulic jack assembly 45, is under a specific pressure. This is also true for pressure chamber 52 of the hydro-pneumatic spring assembly and of the pneumatic medium in the storage device 51, the pressure being maintained when the pump is stationary by means of excess pressure valve 56 in the conduit, which is constructed as a back pressure valve. In order to raise the support platform 19 by means of the jacking device 18, the pump 55 is operated, for example, by means of a pedal switch, and is continued in operation as long as this switch is actuated. The pressure within conduit 57 is increased in this manner and when the pump 55 is set into operation, the return valve 58 may be adjusted to a higher pressure. The check valve 62 is opened, so that the pressure is propagated by way of the conduit 57 and conduit 61 to the pressure chamber 52 in the hydro-pneumatic spring assembly 49 to effect an increase in the pressure of the pneumatic cushion in the storage device 51. As the load upon piston 47 is overcome (the load from the weight of the platform 19 and, for example, the litter carrying a patient) the jack device 18 is actuated to raise the platform so that the platform 19, together with the upper frame 21 and slide 23, assume the position shown in FIG. 4 or in FIG. 1. The flow of the hydraulic medium into the pressure chamber 52 can be adjusted by suitable throttling on the flow-through valve 63/64.

As soon as the jacking device 18 and the platform 19 have reached their uppermost positions, and the pressure within conduit 57 and pressure chamber 48 of the jacking assembly and that within the chamber 52 of the spring assembly tend to increase even higher, with backflow valve 58 opening, to permit a discharge from the pump as pump 55 continues to be operated. There may also be provided an automatic cutoff of the pump device by means of an end switch, if desired.

The spring-like suspension thus realized is maintained as long as the check valve 62 is open. Shocks or other weight changes due to jolts from the road transmitted to the vehicle or vehicle floor and the mass forces of the support platform and patient which occur, are resiliently absorbed by the pneumatic cushion of the storage device 51, as the hyraulic medium oscillates between pressure chambers 48 and 52. By setting the chock 63, oscillating movements can be dampened.

In order to lower the platform 19, the check valve 60 is opened so that pressure fluid can flow back out of the pressure chambers 48 and 52 into the reservoir 54 of the supply assembly. The lowering of the platform advantageously occurs under the weight of the mass of the raised and spring-suspended litter frame, which may include the litter and the patient.

Figure 6:
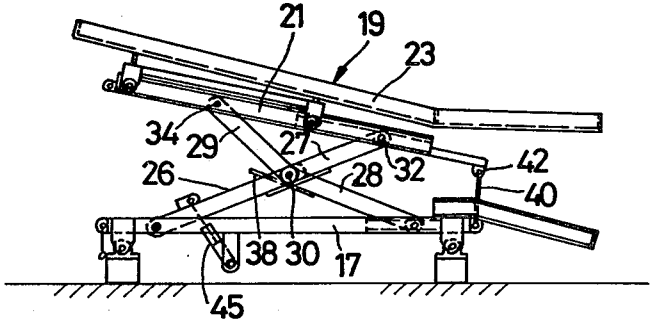
FIG. 6 is a side view of a litter frame which is raised and tilted in a rearward position.
Figure 5:
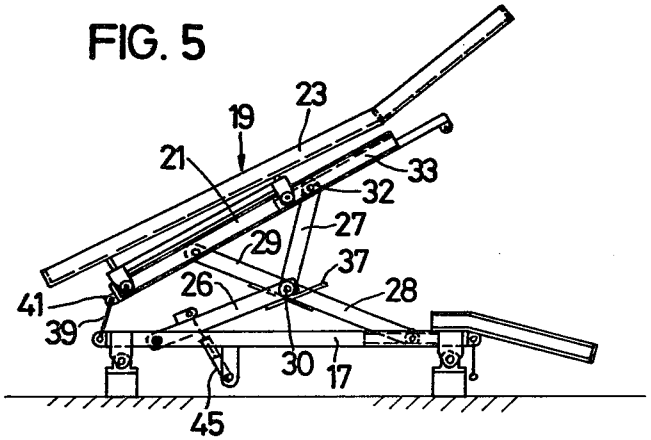
FIG. 5 is a side view of a litter frame which is raised and tilted in a forward position.

FIGS. 5 and 6 illustrate the manner in which the platform can be tilted. This is possible because of the upper arms 27 and 29 of the scissors parts can be raised from their stops 37 and 38 respectively, in that they can be rotated about the pivot point 30, counterclockwise and clockwise, respectively, as shown in the drawing.

FIG. 5 illustrates the lowered head position in which, to maintain the platform 19 in the tilted position, the upper frame 21 is connected with the lower frame 17 by means of the coupling plate 39.

FIG. 6 shows the elevated head position in which the rear end of the upper frame 21, together with the rear end of the lower frame 17, are secured against swinging back around the common pivot point 30 by the coupling plate 40. If the spring suspension is to be cutoff, particularly for heart massage, check valve 62 is closed so that the pneumatic storage device 51 does not affect the hydraulic jack assembly 45. The assembly may also be designed so that the spring-like suspension of the platform may be provided even in its non-raised position.

The hydro-pneumatic jack-spring suspension system described above has the advantage of load independent operation. By providing a predetermined biasing pressure in the pneumatic storage device, a further range of different weights can be resiliently supported with equal advantage. Another essential advantage resides in the possibility of simple and precise regulation of the elasticity, by setting the pressure in the pneumatic storage device. The hydraulic medium, because of its incompressibility, is particularly suited, on the other hand, for compression of the pneumatic medium in the spring storage device. Also, the spring suspension can be cut off simply by blocking the spring storage device, thereby providing a practically absolute inelastic state of the support platform.

In contrast to this, the purely pneumatic system has the advantage in that there is no need for an intermediate hydraulic medium, and even softer cushioning can be attained. A special spring storage device separated from the pneumatic jacking system by a diaphragm, or the like, is unnecessary. For regulation or cutoff of the spring suspension, a special supplementary device is generally needed, however, for example, by means of a mechanical blocking device.

The circuit diagram illustrated in FIG. 2 may be simplified in that the spring assembly 49 in the branch 61 may be eliminated. Instead of the pump 55, there may be provided a compressor or special pressure source which is readily available for other purposes, as is often the case on a motor vehicle, for example. By way of a two-way valve, and a choke which advantageously is adjustable, the pneumatic medium, usually air, can be delivered to the pneumatic jacking and spring suspension system. A pneumatic cylinder, for example a single chamber pneumatic cylinder corresponding to cylinder 45, a bellows or the like can be provided as a jacking assembly, the assembly also being the spring assembly.

Figure 7:
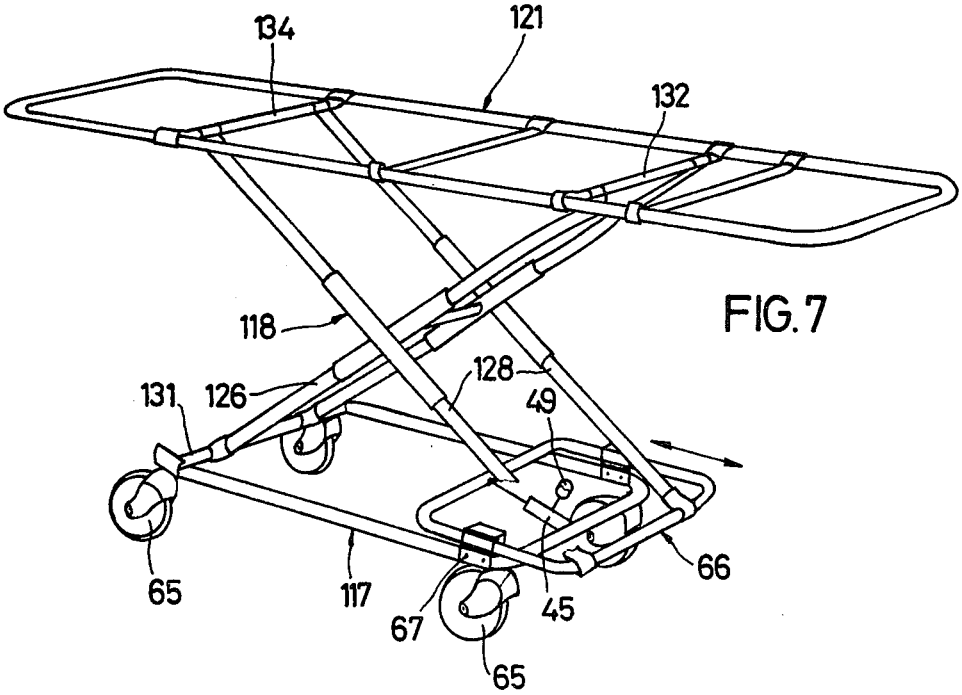
FIG. 7 is a perspective view of the invention for a mobile litter frame.
Figure 8:
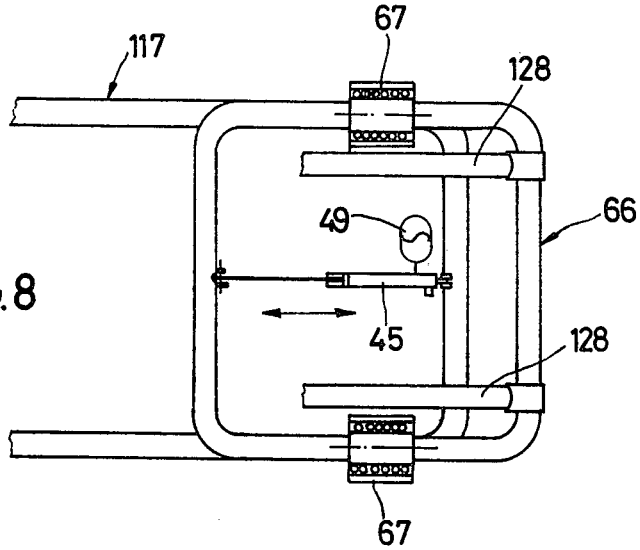
FIG. 8 is a partial plan view of FIG. 7.

A further embodiment of the invention is shown in FIGS. 7 and 8 which shows the use of the invention on a litter frame with a lower frame 117 moveably carried on wheels 65, a jacking device 118 made a scissors frame with two freely crossing arms 126, 128 and an upper frame 121. The arms 126 and 128 are non-displaceably pivoted on cross pieces on the lower and upper frame 117 and 121, respectively, which act as shafts 131, 132 and 134. However, arms 128 are pivoted at the lower ends on a sliding device in the form of a sliding frame 66 longitudinally slidable on a lower frame 117 by means of ball-bearings 67. The hydro-pneumatic jacking-spring assembly 45/59 is connected between the frame 66 and the lower frame 117 so that, by longitudinal shifting of the slide frame, the upper frame 121 can be raised or lowered.

In the embodiment shown in FIG. 9, the frame 221 can be raised or lowered by means of angle-leverlike arms 226, 228 which are pivotably carried on a fixed frame, for example, through a double jack-spring assembly 45/49/45 with a common but separate storage 49. A different activation of jack assembly 45 effects the tilting of the frame 221 about a transverse shaft.

FIG. 10 illustrates an embodiment in which the frame 321 is guided on rollers 365 which are swingably carried by means of swing arms 326, 328 on frame 321. By hydro-pneumatic double jack-spring assembly 45/49/45 with common but separate storage device 49, the frame can be raised and lowered. In other respects, the examples illustrated in FIGS. 7 through 10 are the same as those shown in FIGS. 1 through 6. Moreover, in addition to the above-described arrangements, rather than have the frame raise and lower the litter, the pneumatic or hydro-pneumatic jack-spring assembly can be employed to directly raise or lower the litter.

While I have shown and described several embodiments in accordance with the present invention, it is understood that the same is not limited thereto but is susceptible of numerous changes and modifications as known to a person skilled in the art, and I therefore do not wish to be limited to the details shown and described herein but intend to cover all such changes and modifications as are obvious to one of ordinary skill in the art.

I claim:

1. In an arrangement for raising a supporting platform for a litter frame by a fluid jack assembly, and including a spring-like suspension assembly for said supporting platform, the improvement wherein a pneumatic or hydro-pneumatic jack assembly with a piston-cylinder unit is provided to serve the dual function of raising and providing spring-like suspension, about the whole stroke of said platform from a lowest position to an uppermost position of the platform, for said supporting platform and to effect a spring-like suspension of said platform in a raised position.

2. The improvement according to claim 1, wherein said hydro-pneumatic jack assembly includes a hydraulic jack device actuated by a hydraulic medium, and a hydro-pneumatic spring assembly loaded by said hydraulic medium and a hydraulic supply means for delivering said hydraulic medium under pressure to both said jack device and said spring assembly.

3. The improvement according to claim 2, wherein said spring assembly includes a pneumatic storage device containing a pneumatic medium which is separated from the hydraulic fluid of said hydraulic jack device by a diaphragm.

4. The improvement according to claim 1, further including means for removing spring-like suspension of said platform at any desired height of said device.

5. The improvement according to claim 1, wherein the spring-like suspension of said jack assembly is adjustable.

6. The improvement according to claim 2, wherein said hydraulic jack assembly is connected with said hydro-pneumatic spring assembly by means of an adjustable choke.

7. The improvement according to claim 2, wherein said spring assembly and said hydraulic supply means are separated from the jack assembly at one end of said litter frame.

8. The improvement according to claim 2, wherein the arrangement includes slidably carried transverse shafts for carrying said litter frame with the jack assembly.

9. The improvement according to claim 1, wherein said arrangement includes a scissors frame, upon which said platform is supported, which permits tilting of the platform about a transverse axis.

10. The improvement according to claim 9, wherein said scissors frame comprises a set of crossing arm sections, each arm section including upper and lower arm parts which join and the point of intersection of an arm section, the upper arm parts being pivotable about said point of intersection to permit tilting of said platform.

11. The improvement according to claim 10, wherein said arrangement further includes means for fixing said support platform in an inclined position.

12. The improvement according to claim 1, wherein said jack assembly includes a plurality of pneumatic or hydraulic jack assemblies associated with common spring storage device.

13. The improvement according to claim 1, wherein said arrangement includes a pair of swing arms mounted on rollers and supporting a jackable and lowerable support frame, said jack assembly being connected between said swing arms and said support frame.

14. In an arrangement for raising a supporting platform for a moveable litter frame by a fluid jack assembly and including a spring-like suspension assembly for said supporting platform, the improvement comprising:

said spring-like suspension assembly being constituted by said jack assembly fluidically and a hydro-pneumatic spring assembly coupled directly to said jack assembly, whereby shocks transmitted to said arrangement may be absorbed by said spring assembly permitting displacement of a piston within a cylinder of said jack assembly.

15. The improvement according to claim 14, wherein said spring assembly includes a pneumatic storage device containing a pneumatic medium which is separated from the hydraulic fluid of said hydraulic jack device by a diaphragm.

16. In an arrangement for raising a supporting platform for a litter frame by a fluid jack assembly, and including a spring-like suspension assembly for said supporting platform, the improvement wherein a pneumatic or hydro-pneumatic jack assembly is provided to both raise and provide spring suspension for said supporting platform and to effect spring suspension of said platform in its raised position, wherein said arrangement is adapted for use on a motor vehicle which supplies a pressure source for a pneumatic medium for operating said jack assembly.

17. In an arrangement for raising a supporting platform for a litter frame by a fluid jack assembly, and including a spring-like suspension assembly for said supporting platform, the improvement wherein a pneumatic or hydro-pneumatic jack assembly is provided to both raise and provide spring suspension for said supporting platform and to effect spring suspension of said platform in its raised position, wherein said arrangement includes a scissors frame, upon which said platform is supported, which permits tilting of the platform about a transverse axis, wherein said scissors frame comprises a set of crossing arm sections, each arm section including upper and lower arm parts which join at the point of intersection of an arm section, the upper arm parts being pivotable about said point of intersection to permit tilting of said platform, and wherein each arm section includes a respective stop member to permit only upward bending of the arm sections at said intersection point.

18. In an arrangement for raising a supporting platform for a litter frame by a fluid jack assembly, and including a spring-like suspension assembly for said supporting platform, the improvement wherein a pneumatic or hydro-pneumatic jack assembly is provided to both raise and provide spring suspension for said supporting platform and to effect spring suspension of said platform in its raised position, wherein said hydro-pneumatic jack assembly includes a hyraulic jack device actuated by a hydraulic medium, and a hydro-pneumatic spring assembly loaded by said hydraulic medium, and a hydraulic supply means for delivering said hydraulic medium under pressure to both said jack device and said spring assembly and wherein said support platform comprises a frame which can be raised only by said jack device, and a slide for receiving said litter frame, said slide being movable longitudinally on said frame.

19. In an arrangement for raising a supporting platform for a litter frame by a fluid jack assembly, and including a spring-like suspension assembly for said supporting platform, the improvement wherein a pneumatic or hydro-pneumatic jack assembly is provided to both raise and provide spring suspension for said supporting platform and to effect spring suspension of said platform in its raised position, wherein said hydro-pneumatic jack assembly includes a hydraulic jack device actuated by a hydraulic medium, and a hydro-pneumatic spring assembly loaded by said hydraulic medium, and a hydraulic supply means for delivering said hydraulic medium under pressure to both said jack device and said spring assembly and wherein said jack device comprises a scissors frame having a pair of crossing scissors arms, and a slide device connected to one of the crossing scissors arms and controlled by said pneumatic or hydro-pneumatic suspension assembly, and a relatively stationary support arrangement for said crossing scissors arms.

20. In an arrangement for raising a supporting platform for a litter frame by a fluid jack assembly, and including a spring-like suspension assembly for said supporting platform, the improvement wherein a pneumatic or hydro-pneumatic jack assembly is provided to both raise and provide spring suspension for said supporting platform and to effect spring suspension of said platform in its raised position, wherein said jack assembly includes a plurality of pneumatic or hydraulic jack assemblies associated with a common spring storage device and wherein said arrangement includes a pair of angleleverlike guides supporting said litter frame and supporting platform, and actuated by respective ones of said jack assemblies.

21. An improvement as in claim 1, in combination with a pump, a conduit directly connecting the pump with the cylinder-piston-unit, a branch conduit branching off from said conduit, a hydro-pneumatic spring storage with a chamber part connected to said branch conduit, and a chamber part separated herefrom by a resilient separating means, for the pneumatic medium, and a valve means in the branch conduit.

22. An improvement as in claim 20, in combination with a choke element in the branch conduit.

* * * * *